United States Patent [19]

Tanaka

[11] Patent Number: 4,621,501

[45] Date of Patent: Nov. 11, 1986

[54] REFRIGERATION SYSTEM HAVING AUXILIARY COOLING FOR CONTROL OF COOLANT FLOW

[75] Inventor: Naoki Tanaka, Hyogo, Japan

[73] Assignee: Mitsubishi Denki Kabushiki Kaisha, Tokyo, Japan

[21] Appl. No.: 604,416

[22] Filed: Apr. 30, 1984

Related U.S. Application Data

[63] Continuation of Ser. No. 407,407, Aug. 12, 1982, abandoned.

[30] Foreign Application Priority Data

Aug. 12, 1981 [JP] Japan ..... 56-127484
Aug. 12, 1981 [JP] Japan ..... 56-127485

[51] Int. Cl.[4] ..... F25B 5/00
[52] U.S. Cl. ..... 62/199; 62/513
[58] Field of Search ..... 62/197, 199, 513, 225

[56] References Cited

U.S. PATENT DOCUMENTS

| | | | |
|---|---|---|---|
| 2,943,845 | 7/1960 | Jaklitsch | 165/154 |
| 3,566,615 | 3/1971 | Roeder, Jr. | 62/513 X |
| 3,577,743 | 5/1971 | Long | 62/225 X |
| 4,019,337 | 4/1977 | Zearfoss, Jr. | 62/197 X |
| 4,316,366 | 2/1982 | Manning | 62/513 |

OTHER PUBLICATIONS

Smoluk, George R., Design News, "Valveless Refrigerant Control System", 3-7-77; pp. 40-41.

*Primary Examiner*—William E. Wayner
*Attorney, Agent, or Firm*—Sughrue, Mion, Zinn, Macpeak, and Seas

[57] ABSTRACT

In a refrigeration system, coolant is allowed to branch from a refrigeration circuit part between the midpoint of the condenser and the outlet of the pressure reducing pipe, and is subjected to pressure reduction by a pressure reducing unit to thereby obtain a cooling effect, the reduced temperature branched coolant being utilized to cool the remaining coolant in a refrigeration circuit part between the outlet of the condenser and the outlet of the pressure reducing pipe, whereby the amount of cooling at that time is controlled so that the flow rate of coolant in the refrigeration circuit is also controlled. The branched coolant is allowed to rejoin the refrigeration circuit part between the midpoint of the pressure reducing pipe and the midpoint of the evaporator, whereby the flow rate of coolant can be maintained suitable. Even if the branched coolant is not completely evaporated prior to recombining, no solution returns to the compressor, which contributes to stabilization of the system operation.

1 Claim, 19 Drawing Figures

REFRIGERATION SYSTEM HAVING AUXILIARY COOLING FOR CONTROL OF COOLANT FLOW

This application is a continuation, of application Ser. No. 407,407, filed 8/12/82 & now abandoned.

BACKGROUND OF THE INVENTION

This invention relates to a gas compression type refrigeration system for cooling and/or heating which utilizes the latent heat of the coolant, and more particularly to the control of the coolant flow rate in such a system.

FIG. 1 shows one example of a conventional refrigeration system. In FIG. 1, reference numeral 1 designates a compressor; 2, a condenser, 3, a pressure reducing pipe; and 4, an evaporator. These components are connected to form a closed refrigeration circuit in which coolant circulates.

In such a conventional refrigeration system, the temperature and pressure of the coolant gas are increased by the compressor 1 and the gas is then liquified by cooling in the condenser 2. The temperature and pressure of the coolant liquid are decreased by the pressure reducing pipe 3, and the coolant liquid thus treated is introduced into the evaporator 4. In the evaporator 4, the coolant liquid absorbs heat from the environment while evaporating into a gaseous phase, thereby performing refrigeration. Thereafter, the coolant gas is drawn into the compressor 1 and the cycle is repeated. In FIG. 1, the arrows indicate the flow of the coolant.

It is well known in the art that, in such a refrigeration system, the suitable coolant flow rate depends on the evaporation temperature, and the coolant flow rate should be increased as the evaporation temperature increases. However, the conventional refrigeration system as shown in FIG. 1 is disadvantageous in that the coolant flow rate cannot be sufficiently adjusted. Therefore, when the evaporation temperature is high, the coolant flow rate is insufficient. Accordingly, the degree of superheat of the coolant at the outlet of the evaporator becomes excessively large, and the temperature of the compressor is increased. In addition, when the evaporation temperature is low, the coolant flow rate becomes excessive and liquid may return to the compressor, i.e. coolant may not have sufficient time to fully evaporate before arriving at the compressor input.

SUMMARY OF THE INVENTION

An object of this invention is to eliminate the above-described drawbacks accompanying a conventional refrigeration system.

In a refrigeration system, according to this invention, coolant is allowed to branch from a refrigeration circuit from a point between the midpoint of the condenser and the outlet of the pressure reducing pipe, and is subjected to pressure reduction by a further pressure reducing unit to thereby obtain a lower temperature branched coolant. The lower temperature branched coolant is then utilized to cool the remaining coolant in a refrigeration circuit part between the outlet of the condenser and the outlet of the pressure reducing pipe. The degree of cooling is preferably controlled by controlling the flow rate of coolant in the refrigeration circuit. The lower temperature branched coolant is allowed to rejoin the main refrigeration circuit somewhere between the midpoint of the pressure reducing pipe and the midpoint of the evaporator, whereby the coolant flow rate can be maintained at a suitable level, and even if the branched coolant is not completely evaporated, no solution returns to the compressor, which contributes to stabilization of the operation.

BRIEF DESCRIPTION OF THE DRAWINGS

The invention will be more clearly understood from the following description of the preferred embodiments in conjunction with the accompanying drawings wherein like parts are designated by like reference numerals or characters, and in which.

DETAILED DESCRIPTION OF THE INVENTION

Figure 1:
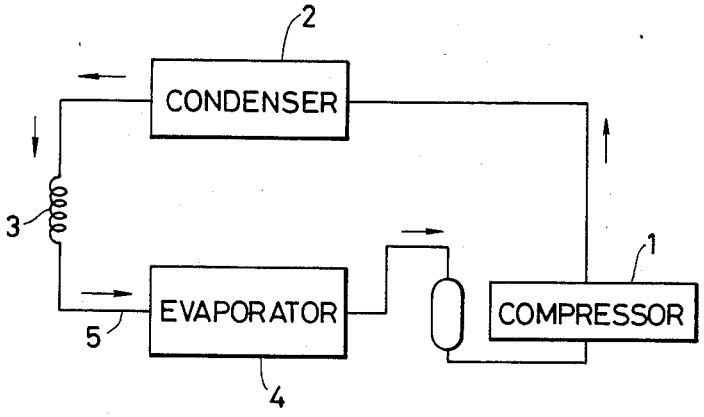
FIG. 1 is a flow circuit diagram of a conventional refrigeration system.
Figure 2:
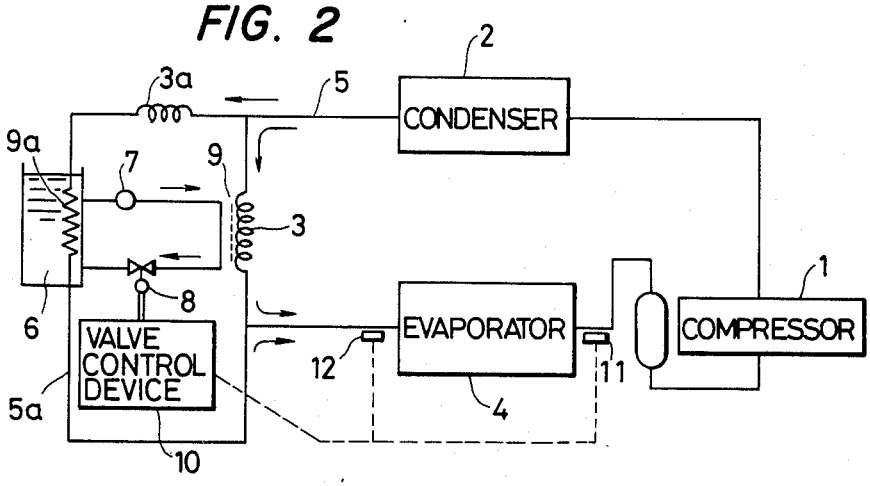
FIG. 2 is a flow circuit diagram of a refrigeration system according to a first embodiment of this invention.
Figure 3:
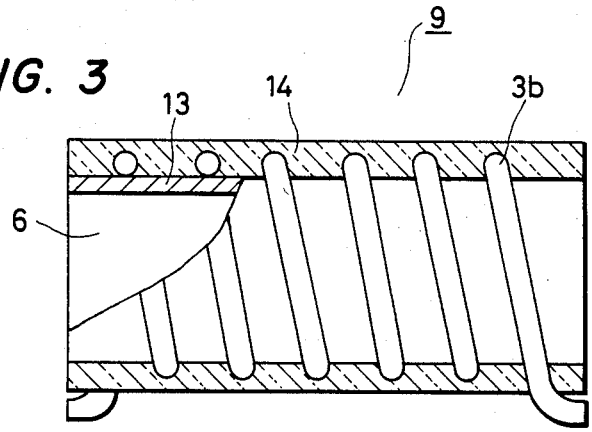
FIG. 3 is a sectional view of a heat exchanger which may be utilized in the embodiment of FIG. 2.

FIGS. 2 and 3 show the arrangement of a first embodiment of the invention. In FIGS. 2 and 3, those components which have been previously described with reference to FIG. 1 are designated by the same reference numerals or characters and will not be described in detail. This same practice will be applied to other figures as well.

In FIG. 2 reference character 3*a* designates a pressure reducing unit, which may be a pressure reducing pipe; 9*a*, a heat exchanger; 5*a*, a coolant splitting pipe having one end connected to the outlet of the condenser 2 and having its other end connected through the pressure reducing unit 3*a* and the heat exchanger 9*a* to the outlet of the pressure reducing pipe 3; 6, a cooling solution which is cooled through the heat exchanger 9*a* by the temperature decrease which is generated when the pressure of the coolant in pipe 5*a* is reduced by the pressured reducing unit 3*a*; 7, a pump for circulating the cooling solution 6; 8, a flow adjusting valve for adjusting the flow rate of the cooling solution; 9, a heat exchanger for cooling the coolant in the pressure reducing pipe 3 with the cooling solution; and 10, a valve control device which controls the flow adjusting valve 8 according to the difference between a temperature which is indicated by a thermometer 11 adapted to measure the coolant temperature at the outlet of the evaporator 4 and a temperature which is indicated by a thermometer 12 adapted to measure the coolant temperature at the inlet of the evaporator 4, so that the temperature difference becomes a predetermined value.

FIG. 3 shows in more detail the structure of the heat exchanger 9. The pressure reducing pipe 3 comprises a capillary tube 3*b*. The cooling solution 6 flows in a central pipe 13, and the coolant which flows in the capillary tube 3*b* surrounding the pipe 13 is cooled down not only by the normal pressure reducing effect of the reducing pipe 3 but also by the auxiliary cooling effect of the cooling solution 6. In FIG. 3, reference numeral 14 designates a heat insulating material. The arrows in FIGS. 2 and 3 indicate the directions of flow of the coolant and the cooling solution.

With the refrigeration system thus arranged, the temperature of the cooling solution 6 is lowered by the heat exchanger 9*a* with the aid of a low temperature branched coolant which is provided by the pressure reducing unit 3*a*. As the cooling solution 6 thus generated is circulated by the pump 7, the remaining coolant in the pressure reducing pipe 3 is cooled down through both pressure reduction and through the heat exchanger 9. The amount of auxiliary cooling can be controlled by controlling the flow adjusting valve 8 by the valve control device 10 so as to control the flow rate of cooling the solution 6. In this connection, the degree of opening of the flow adjusting valve 8 can be controlled by a valve lift control device 10 which is operated electrically or mechanically. For instance, the degree of opening of the flow adjusting valve can be maintained by the control device 10 so that the temperature at the outlet of the evaporator 4 is slightly higher than that at the inlet of the evaporator 4 at all times, i.e., so that the coolant is completely gasified at the outlet of the evaporator and is slightly superheated, whereby the coolant can be supplied at a correct flow rate at all times.

Figure 4:
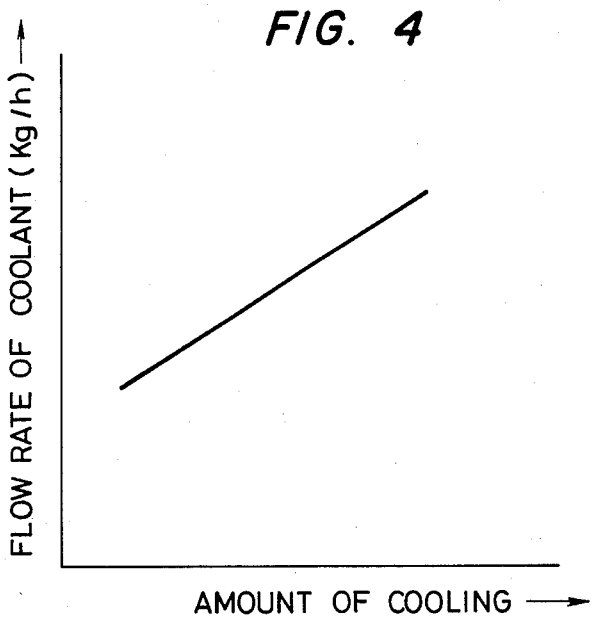
FIG. 4 is a graph of cooling effect versus coolant flow rate in the embodiment of FIG. 2.

The relationship between the amount of cooling of the coolant and the flow rate of the coolant is as indicated in FIG. 4. As shown therein, as the amount of cooling increases, the flow rate of the coolant is increased. This is due to the fact that, as the amount of cooling is increased, the content of gas in the two-phase (liquid and gas) flow of coolant provided in the pressure reducing pipe 3 such as a capillary tube 3*b* is decreased, and accordingly the fluid resistance is decreased to thereby increase the coolant flow rate.

The coolant flow rate can be suitably controlled by utilizing this characteristic. In other words, the coolant flow rate can be suitably controlled by detecting temperatures at the inlet and outlet of the evaporator 4, and changing the valve lift of the flow adjusting valve 8 according to the difference between the temperatures thus detected so that the degree of superheat of the coolant at the outlet of the evaporator is maintained unchanged, to thereby control the amount of cooling of the coolant.

In the above-described embodiment, the auxiliary cooling operation is performed on the coolant in the pressure reducing pipe 3. However, it should be noted that the same effect can be obtained by performing an auxiliary cooling operation on the coolant at the outlet of the condenser 2.

Figure 5:
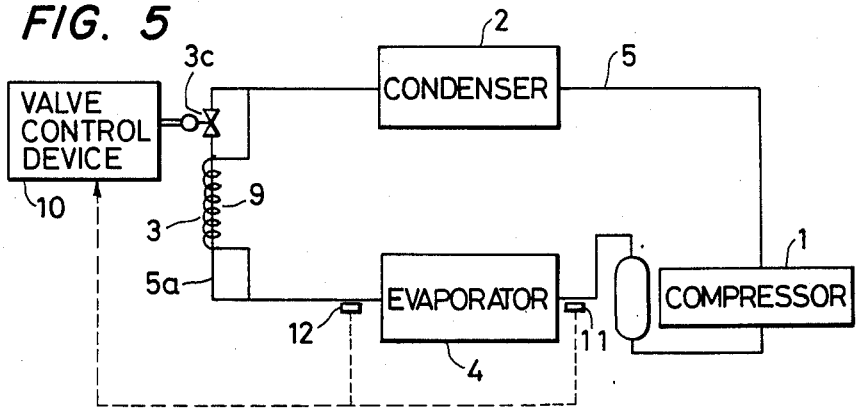
FIG. 5 is a flow circuit diagram of a refrigeration circuit according to a second embodiment of the present invention.

In the above-described embodiment, the cooling solution is interposed to transmit the cooling effect of the branched coolant in pipe 5*a* to the remaining coolant in the pressure reducing pipe 3. However, as shown in FIG. 5, pipe 5*a* may be provided between the outlet of the condenser 2 and the outlet of the pressure reducing unit 3 through a controllable pressure reducing unit, e.g., a pressure reducing valve 3*c*. The coolant at the outlet of the condenser 2 thus branches into the pipe 5*a* and the pressure of the branched coolant is reduced by the pressure reducing valve 3*c*, as a result of which the temperature of the coolant in pipe 5*a* is decreased. With this branched coolant as a direct cooling source, the remaining coolant in the pressure reducing pipe 3 is cooled and is then combined with the coolant from pipe 5*a* at the outlet of the pressure reducing pipe 3. Control of the flow rate of the coolant in the pipe 5*a* is carried out by adjusting the pressure reducing valve 3*c* with the valve control device 10.

Figure 6:
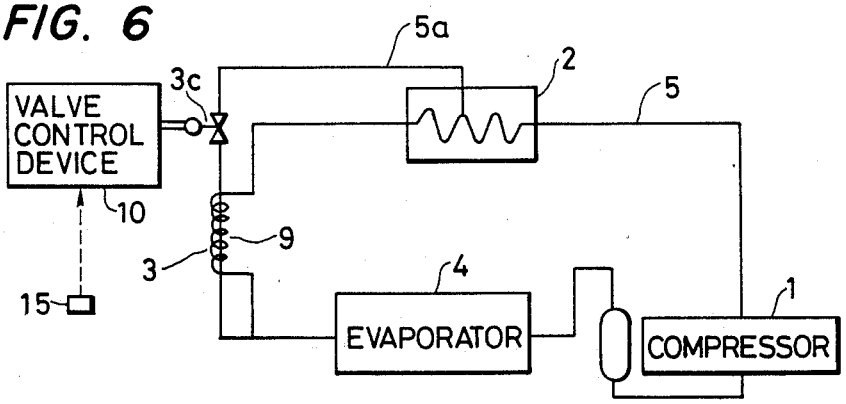
FIG. 6 is a flow circuit diagram of a refrigeration circuit according to a third embodiment of the present invention.

In the case of FIG. 6, the inlet end of the pipe 5*a* is connected to the midpoint of the condenser 2, from which point the coolant branches into the pipe 5*a*. In FIG. 6, reference numeral 15 designates a thermometer for detecting atmospheric temperature. The valve control device 10 may be controlled according to the atmospheric temperature, to thereby adjust the pressure reducing valve 3*c*.

Figure 7:
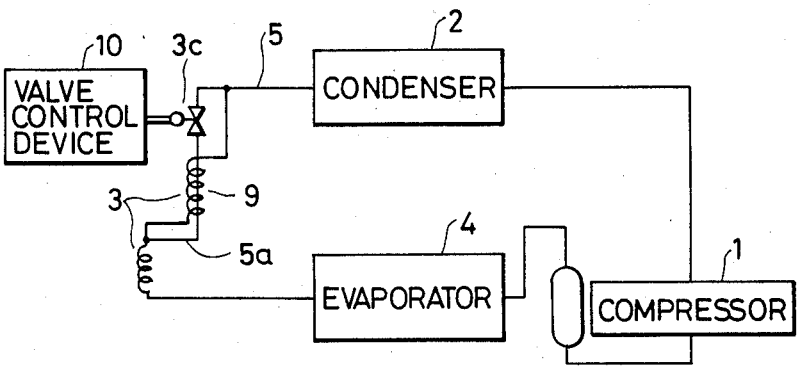
FIG. 7 is a flow circuit diagram of a refrigeration circuit according to a fourth embodiment of the present invention.
Figure 8:
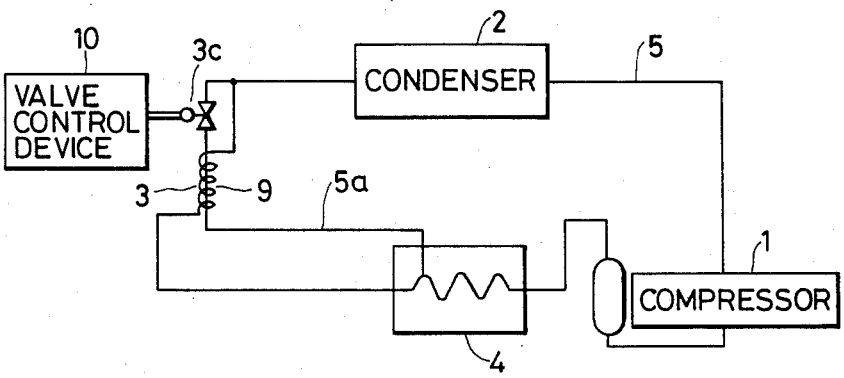
FIG. 8 is a flow circuit diagram of a refrigeration circuit according to a fifth embodiment of the present invention.

It is not always necessary for the reconnection point of the outlet end of the pipe 5*a* and the refrigeration circuit, where the coolant in the pipe 5*a* rejoins the refrigeration circuit, to be at the outlet of the pressure reducing pipe 3, i.e., at the inlet of the evaporator 4 as shown in FIG. 5 or 6. That is, the connection point may be at any point between the midpoint of the pressure reducing unit 3 (as shown in FIG. 7) and the midpoint of the evaporator 4 (as shown in FIG. 8) if the coolant pressure at that point is lower than that at the inlet end of the pipe 5*a*. With the connection point of the outlet end of the pipe 5*a* and the refrigeration circuit selected as described above, even if the coolant in the pipe 5*a* is not completely evaporated at the heat exchanger 9 or 9*a*, the coolant can evaporate downstream of the heat exchanger due to the lower pressure and since it will still pass through at least half of the evaporator. Accordingly, the heat exchangers 9 and 9*a* may be of small capacity. Furthermore, even if the pressure reducing valve 3*c* is operated coarsely, no liquid solution is returned to the compressor 1, i.e. the operation is stable.

Figure 9:
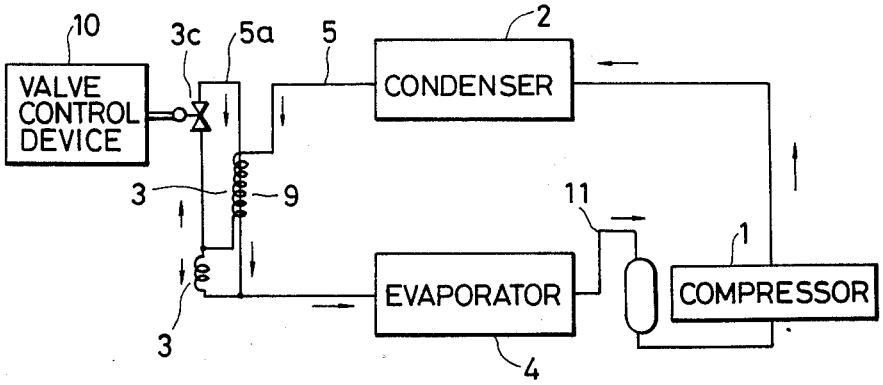
FIG. 9 is a flow circuit diagram of a refrigeration circuit according to a sixth embodiment of the present invention.
Figure 10:
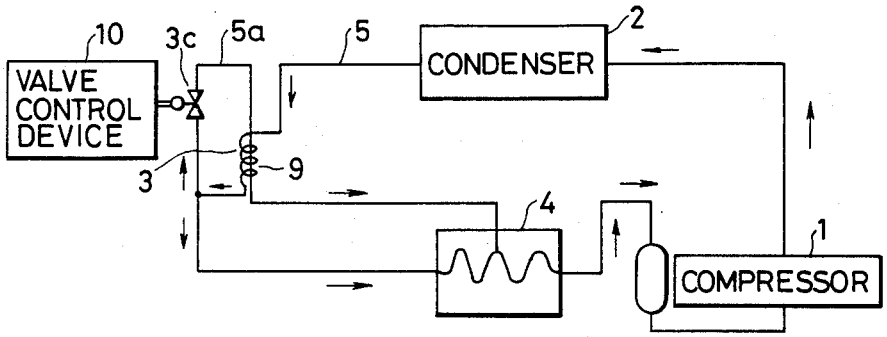
FIG. 10 is a flow circuit diagram of a refrigeration circuit according to a seventh embodiment of the present invention.

The branching point of the inlet end of the pipe 5*a* from the refrigeration circuit may be the outlet of the condenser 2 as shown in FIG. 2 or 5, or the midpoint of the condenser 2 as shown in FIG. 6. However, the invention is not limited thereto or thereby. That is, the same effect can be obtained by selecting the midpoint of the pressure reducing pipe 3 as shown in FIG. 9 or the outlet of the pressure reducing pipe 3 as shown in FIG. 10. More specifically, the branching point of the inlet end of the pipe 5*a* from the refrigeration circuit may be any point between the midpoint of the condenser 2 and the outlet of the pressure reducing pipe 3. It goes without saying that the reconnection point of the outlet end of the pipe 5*a* to the refrigeration circuit is downstream of the branching point of the inlet end from the refrigeration circuit, and it is necessary that the coolant pressure at the reconnection point of the outlet end is lower than at the branching point of the inlet end.

Figure 11:
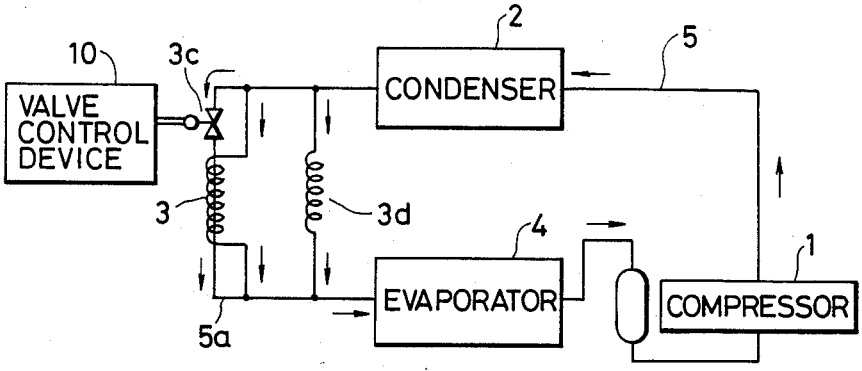
FIG. 11 is a flow circuit diagram of a refrigeration circuit according to an eighth embodiment of the present invention.
Figure 12:
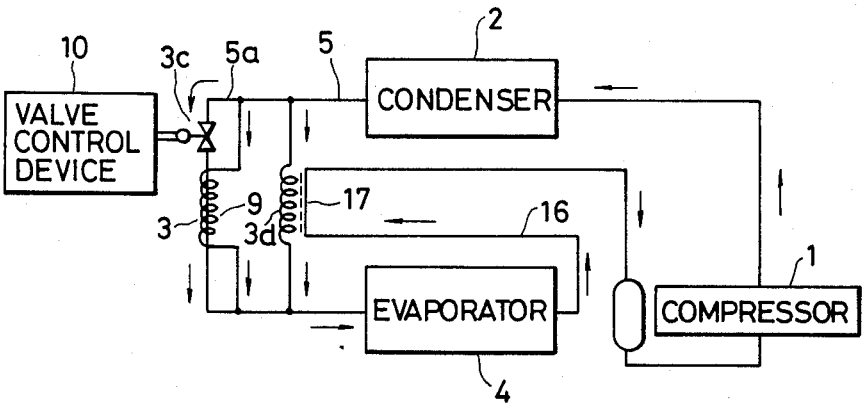
FIG. 12 is a flow circuit diagram of a refrigeration circuit according to a ninth embodiment of the present invention.

In a device as shown in FIG. 11 in which a pressure reducing pipe 3*d* is connected between the condenser 2 and the evaporator 4, the same effect can be obtained by subjecting only a part of the coolant to flow rate control. It goes without saying that the same effect can also be obtained in the case where only a part of the coolant is subjected to heat exchange with the aid of a suction pipe 16 and a heat exchanger 17 as shown in FIG. 12.

Figure 13:
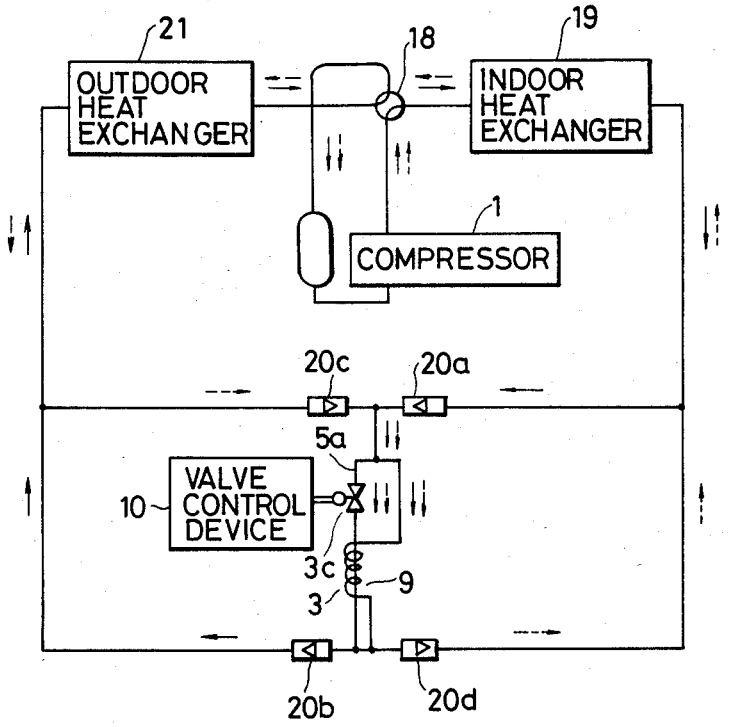
FIG. 13 is a flow circuit diagram of a refrigeration circuit according to a tenth embodiment of the present invention.

Described above are simple refrigeration systems. Shown in FIG. 13 is a heat pump system comprising a four-way control valve 18, an indoor heat exchanger 19, check valves 20*a* through 20*d* and an outdoor heat exchanger 21 which can also maintain a suitable coolant flow rate. In FIG. 13, a heating circuit is indicated by the solid line arrows, and a cooling circuit is indicated by the dotted line arrows.

During heating, coolant from the compressor 1 is supplied through the control valve 18 into the indoor heat exchanger 19. In this case, the indoor heat exchanger serves as condenser, and the coolant is condensed to release heat into the room. Thereafter, the coolant is delivered through the check valve 20*a*, the pressure reducing pipe 3 and the check valve 20*b* into the outdoor heat exchanger 21. The outdoor heat exchanger 21 serves as an evaporator, and the coolant is evaporated to absorb heat. The coolant is then drawn into the compressor 1 through the valve 18 and is discharged out of the compressor 1 to begin the cycle.

During cooling, the coolant delivered out of the compressor 1 is supplied through the valve 18 into the outdoor heat exchanger 21. In this case, the outdoor heat exchanger 21 serves as the condenser, and the coolant is condensed to release heat. The coolant is then delivered through the check valve 20*c*, the pressure reducing pipe 3 and the check valve 20*d* into the indoor heat exchanger 19. The indoor heat exchanger 19 functions as an evaporator, and the coolant is evaporated to cool the air in the room. The coolant is then drawn into the compressor 1 through the control valve 18 and is delivered out of the compressor 1 to begin the cycle again.

In each of the two cases described above, the inlet end of the pipe 5*a* is connected to the outlet of the condenser, and the outlet end is connected to the outlet of the pressure reducing pipe 3. Room temperature or the like operates the valve control device 10 to control the pressure reducing valve 3*c* to thereby control the coolant flow rate in the pipe 5*a*, whereby the amount of cooling at the heat exchanger 9 is controlled and the coolant flow rate in the pressure reducing pipe 3 is adjusted. Thus, the invention is equally applicable to the heat pump of FIG. 13.

Figure 14:
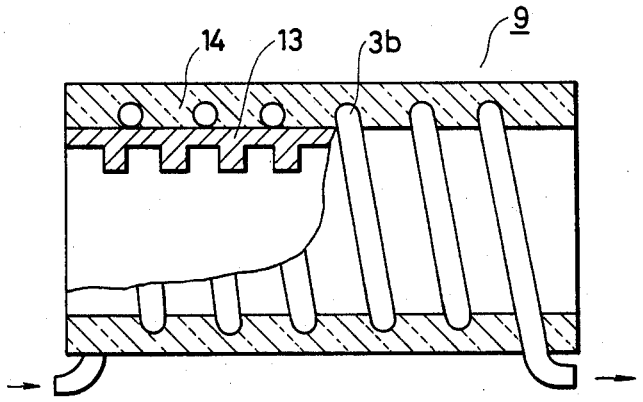
FIG. 14 is a sectional view of a further heat exchanger configuration which may be employed in the various embodiments of the present invention.

FIGS. 14 through 17 show different examples of the heat exchanger between the pressure reducing pipe and the pipe 5*a*. The heat exchanger in FIG. 14 is substantially similar to that in FIG. 3. A pipe 13 with internal fins is employed to provide an excellent heat conducting effect. The low temperature coolant in the pipe 5*a* flows in the pipe 13 in a heat exchange relationship with the coolant in the pressure reducing pipe 3*b*.

Figure 15:
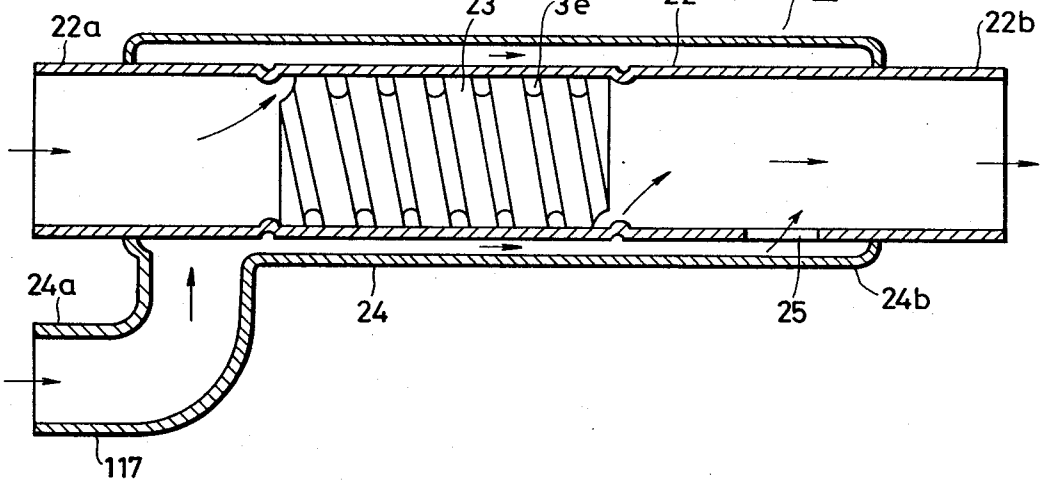
FIG. 15 is a sectional view of a still further heat exchanger which may be used in the various embodiments of the present invention.

The heat exchanger in FIG. 15 is of a dual pipe structure. An inner pipe 22 has one end 22*a* connected to the condenser 2 and the other end 22*b* connected to the evaporator 4. A cylindrical insert 23 has spiral grooves in its outer wall. The cylindrical insert 23 is inserted into the inner pipe 22 in such a manner that a spiral capillary tube 3*e* is formed therebetween, i.e., the pressure reducing pipe 3 is formed. The inner pipe 22 is covered by an outer pipe 24. The outer pipe 24 has one end 24a connected to the pressure reducing unit 3*c* and the other end 24*b* connected to the inner tube through a small hole 25. The coolant in the inner pipe 22 (or the coolant in the refrigeration circuit) is allowed to flow in through the one end 22*a* and to flow out of the other end 22*b* through the capillary tube 3*e*. On the other hand, the low temperature coolant in the outer pipe 24 (or the coolant in the pipe 5*a*) is allowed to flow in through the one end 24*a* and to exchange heat with the coolant in the capillary tube 3*e* through the inner pipe 22. Thereafter, the coolant thus processed joins the coolant in the inner pipe 22 through the small hole 25. In the case of the heat exchanger shown in FIG. 15, both ends of the inner pipe 22, the condenser outlet pipe and the evaporator inlet pipe can be readily connected to one another because they can be made equal in diameter, which contributes to miniaturization. In the example shown in FIG. 15, all of the capillary tube 3*e* is included in the dual pipe region; however, the heat exchanger may be so designed that only a part of the capillary tube is included in the dual pipe region. Furthermore, the small hole 25 may be cut in a part of the capillary tube 3*e* and/or a plurality of small holes may be formed.

Figure 16:
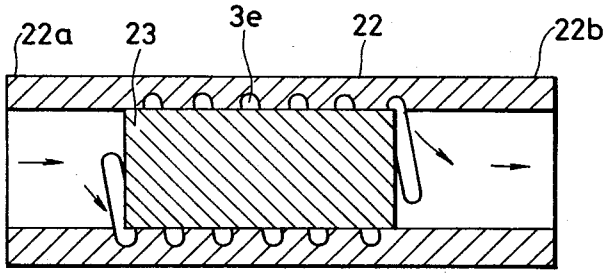
FIG. 16 is a sectional view of a still further heat exchanger which may be used in the various embodiments of the present invention.

In the case of FIG. 16, a spiral groove is cut in the inner wall of an inner pipe having a relatively large wall thickness, and then a cylindrical insert 23 is inserted into the inner pipe 22 so as to cover the spiral groove and thereby form a capillary tube 3*e*, with the heat exchanger of FIG. 16 otherwise being identical to that shown in FIG. 15.

Figure 17:
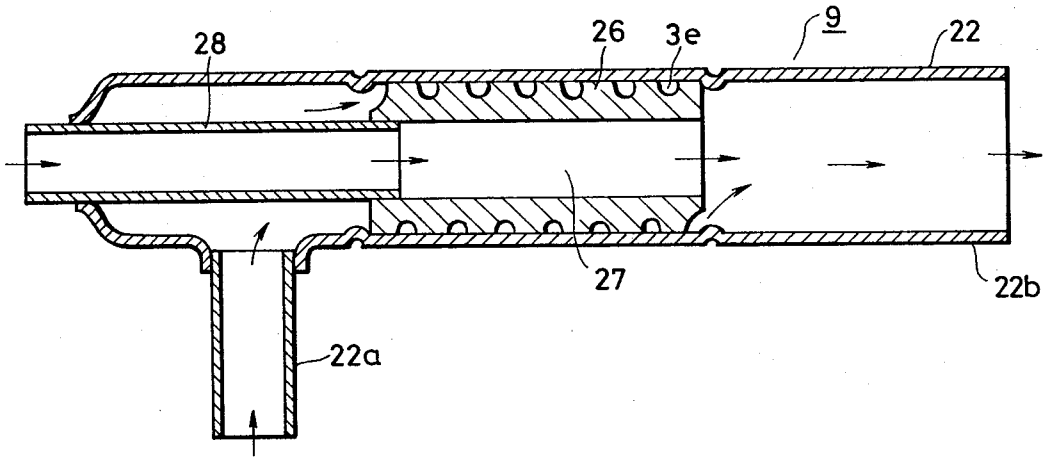
FIG. 17 is a sectional view of a still further heat exchanger which may be used in the various embodiments of the present invention.

In FIG. 17, reference numeral 26 designates an insert having a through-hole 27; and 28, an insertion pipe connected to the through-hole 27. Low temperature coolant (in the pipe 5*a*) flows through the insertion pipe 28 and the through-hole 27. The coolant (in the refrigeration circuit) which flows in through one end 22*a* of outer pipe 22 is subjected to heat exchange with the coolant in the through-hole while passing through the capillary tube 3*e*, and thereafter the two coolants joint each other.

Figure 18:
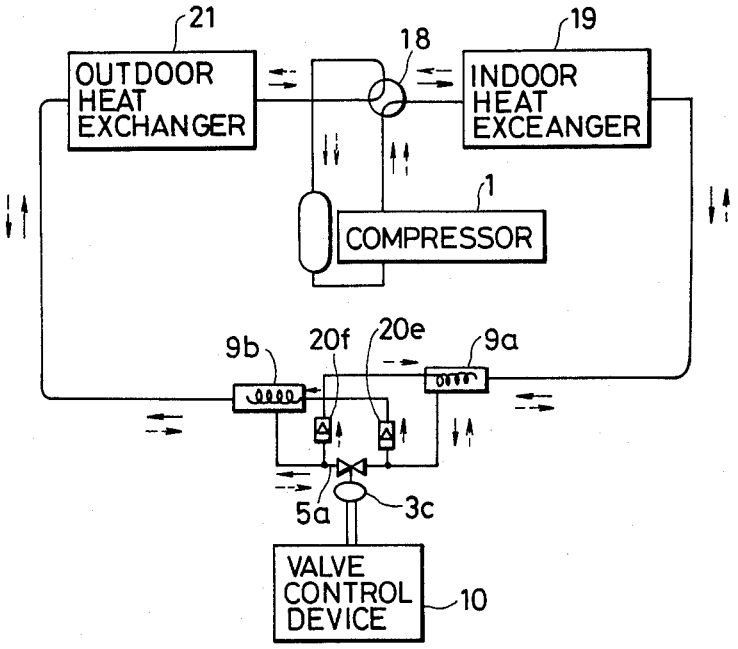
FIGS. 18 and 19 are flow circuit diagrams of further embodiments of the present invention utilizing heat pumps.
Figure 19:
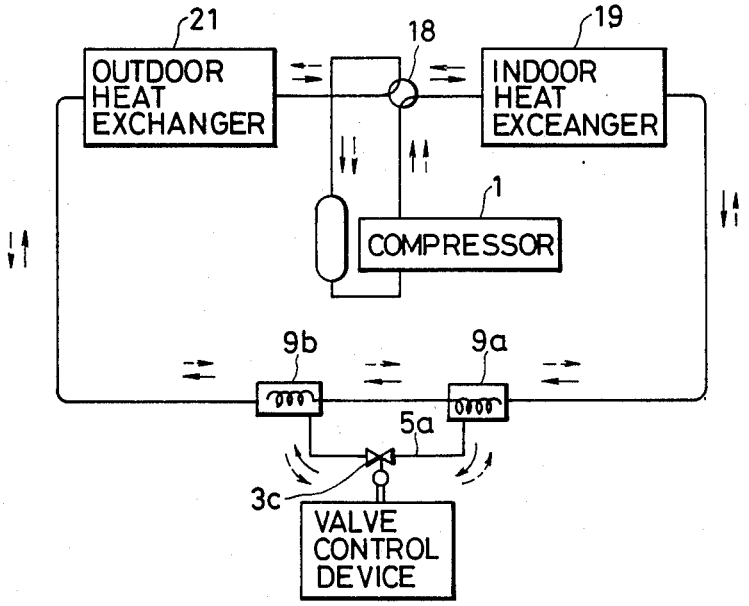

FIGS. 18 and 19 show other embodiments of the invention utilizing the heat exchangers shown in FIGS. 15 and 17. In the case of FIG. 18, during heating, coolant is delivered out of the indoor heat exchanger 19 which has functioned as condenser. The coolant passes in a reverse direction through a heat exchanger 9*a* of the type shown in FIG. 15, i.e. it flows in through end 22*b*, hole 25, outer pipe 24 and end 24*a* without substantial pressure reduction. It then flows through the check valve 20*e* and the pressure reducing pipe (the capillary tube 3*e* in FIG. 15) of the heat exchanger 9*b*. The coolant is then finally delivered to the outdoor heat changer which functions as an evaporator. In this case, the coolant in the pipe 5*a* branches upstream of the check valve 20*e* and passes through the pressure reducing unit 3*c*, where its temperature is reduced. Then, the branched coolant is subjected to heat exchange with the coolant in the capillary tube of the heat exchanger 9*b* (passing outside in FIG. 15) and joins the coolant from the capillary tube.

Similarly, during cooling, coolant delivered out of the outdoor heat exchanger 21 which has functioned as a condenser passes in a reverse direction through the heat exchanger 9*b* without pressure reduction, and thence through the check valve 20*f* and the pressure reducing pipe at the heat exchanger 9*a*. Thereafter, the coolant is introduced into the indoor heat exchanger functioning as an evaporator. In this case, the coolant in the pipe 5*a* branches upstream of the check valve 20*f* and passes through the pressure reducing unit 3*c*, where its temperature is reduced. The branched coolant thus treated is subjected to heat exchange with the coolant in the pressure reducing pipe at the heat exchanger 9*a*.

In the case of FIG. 18, two heat exchangers, i.e. heat exchangers 9*a* and 9*b*, are used. During heating or cooling, the coolants exchange heat with each other in one of the heat exchangers, but heat exchange does not occur in the other heat exchanger because the pressure reducing pipe is not used.

In the embodiment shown in FIG. 19, heat exchangers 9*a* 9*b* as shown in FIG. 15 are also employed. During heating, the coolant in the refrigeration circuit is led out of the indoor heat exchanger 19 and is introduced through the pressure reducing pipe of the heat exchanger 9*a* and the pressure reducing pipe of the heat exchanger 9*b* into the outdoor heat exchanger 21. In this case, the branched coolant in the pipe 5*a* passes through the outside path (FIG. 15) of the heat exchanger 9*a* without substantial pressure reduction and therefore is close to the same temperature as the remaining coolant at this point so that little heat exchange occurs. The branched coolant is then subjected to pressure reduction by the pressure reducing unit 3*c*, where its temperature is reduced. The coolant thus treated is subjected to heat exchange with the coolant in the pressure reducing pipe at the heat exchanger 9*b*.

Similarly, during cooling, the coolant in the refrigeration circuit is led out of the outdoor heat exchanger 21, and is then introduced through the pressure reducing pipes of the heat exchangers 9*b* and 9*a* into the indoor heat exchanger 19. In this case, the coolant in the pipe 5*a* passes through the heat exchanger 9*b* with little heat exchange and is then subjected to pressure reduction by the pressure reducing pipe 3*c*, where its temperature is reduced. The branched coolant thus treated is subjected to heat exchange with the remaining coolant in the pressure reducing pipe at the heat exchanger 9*a* and rejoins the coolant in the pressure reducing pipe.

In the embodiment of FIG. 19, two heat exchangers 9*a* and 9*b* are used in such a manner that during both cooling and heating, the coolant in the refrigeration circuit passes through the pressure reducing pipes of the two heat exchangers. The coolant in the pipe 5*a* passes through the heat exchangers 9*a* and 9*b*, and it is only when the branched coolant passes through the pressure reducing unit 3*c* that its pressure is reduced and its temperature is therefore also reduced. Thus, the branched coolant is subjected to heat exchange at the heat exchanger 9*a* or 9*b* after passing through the pressure reducing unit 3*c*. The embodiment of FIG. 19 is simpler in construction than the others because no check valves are used.

What is claimed is:

1. In a refrigeration system of the type having a refrigeration circuit path in which a coolant passes, in order, through a compressor, a condenser, a pressure reducing means, an evaporator and back to said compressor for recirculation, the improvement comprising a branched coolant path having an inlet coupled to said refrigeration circuit path at a branching connection point for receiving a portion of said coolant from said refrigeration circuit path and an outlet coupled to said refrigeration circuit path at a reconnection point prior to the outlet of said evaporator at which said branched coolant after flowing through said branched coolant path is recombined with the remaining coolant in said refrigeration circuit path, said branched coolant path including branched pressure reducing means for reducing the pressure of said branched coolant to obtain lower temperature branched coolant and heat exchange means for subjecting said lower temperature branched coolant to heat exchange with the remaining coolant in a portion of said refrigeration circuit path, a valve control means for controlling the heat exchange rate of said branched coolant in response to a control signal and control means for generating said control signal provided to said valve control means, and wherein said heat exchange means comprises a central pipe having an inner wall with a spiral groove therein an insert within said central pipe and having a substantially smooth cylindrical outer surface cooperating with said spiral groove in said inner wall to form a spiral path comprising said pressure reducing means, and an outer pipe surrounding said inner pipe and carrying said lower temperature branched coolant.

* * * * *